United States Patent [19]

Bachmann et al.

[11] Patent Number: 4,682,553

[45] Date of Patent: Jul. 28, 1987

[54] SEWING MACHINE WORKPIECE EDGE ALIGNMENT APPARATUS

[75] Inventors: Jean-Marie Bachmann; Jacques Pion, both of St. Julien-les-Villas; Jean-Pierre Raisin, Troyes, all of France

[73] Assignee: Institut Textile de France, Boulogne Billancourt, France

[21] Appl. No.: 829,836

[22] Filed: Feb. 14, 1986

[30] Foreign Application Priority Data

Feb. 21, 1985 [FR] France ..... 85 02519
Jul. 26, 1985 [FR] France ..... 85 11509

[51] Int. Cl.[4] ..... D05B 19/00; D05B 27/14

[52] U.S. Cl. ..... 112/121.12; 112/153; 112/306; 112/308; 112/313; 271/227

[58] Field of Search ..... 271/227; 112/306, 308, 112/309, 313, 121.12, 153

[56] References Cited

U.S. PATENT DOCUMENTS 3,650,229 3/1972 Rovin ..... 112/308 X
3,693,561 9/1972 Hrinko, Jr. et al. ..... 112/308 X
3,889,614 6/1975 Nicolay et al. ..... 112/153
3,903,820 9/1975 Kleinschmidt et al. ..... 112/153
4,019,447 7/1977 Blessing et al. ..... 112/308 X
4,312,281 1/1982 Doyen et al. ..... 112/309 X
4,541,347 9/1985 Kawaguchi et al. ..... 112/121.11

FOREIGN PATENT DOCUMENTS 2252008 10/1973 France .

*Primary Examiner*—Werner H. Schroeder
*Assistant Examiner*—Andrew M. Falik
*Attorney, Agent, or Firm*—Louis Weinstein

[57] ABSTRACT

An installation for linear treatment, such as the edging of textile pieces. It comprises a sewing machine, equipped with a feed dog/presser foot system, a work table which supports the piece during edging, a detection device and two recentering means controlled together or independently of each other by the instructions given by the detection device. The two recentering means consist, on the one hand, of an active guide placed immediately in front of the presser foot and ensuring displacement of that part of the piece located near the presser foot, substantially transversely with respect to the line of stitching, and, on the other hand, of a mobile support placed upstream of the active guide presenting a mobile flat surface, on the same plane as the work table.

21 Claims, 6 Drawing Figures

SEWING MACHINE WORKPIECE EDGE ALIGNMENT APPARATUS

BACKGROUND OF THE INVENTION

The present invention relates to apparatus for stitching along the line parallel to an edge of a supple workpiece and comprising:

a machine such as a sewing machine;

a drive device for moving the workpiece, including the feed dog and pressure foot of the sewing machine;

a worktable for supporting the workpiece;

and a correction device for detecting the workpiece and including recentering means controlled by the detection device for moving the workpiece in the desired manner.

French Pat. No. 2,525,008 discloses recentering means which is comprised of a turntable having a plurality of shoes applied to the workpiece during treatment. The installation described therein is complicated and required that the workpiece be held flat to prevent creasing.

French Pat. No. 2,457,920 discloses recentering means rotated by drive means under the control of an action device to follow a curved edge but is not cable of following a changing profile such as one having a successive convex/concave curvature nor is the apparatus usable to treat workpieces of reduced dimensions.

The present invention overcomes the disadvantages of the prior art by providing recentering means comprising an active guide and drive means cooperating to move the workpiece.

The workpiece is initially delivered to the worktable whereupon the detection device controls the recentering of the workpiece by displacement of the active guide and the movable support either alone or in combination. The aforesaid installation compared with conventional installations provide more precise recentering.

The detection device comprises first and second detectors arranged between the drive device of the sewing machine and the active guide. A third detector is located upstream relative to the active guide and remote from a reference line parallel to the treatment line and tangential to the edge of the workpiece at the point of treatment.

In those cases where the workpiece has a convex edge, four detectors are employed, the fourth detector being located upstream relative to the active guide and to the left of the aforesaid reference line.

In a preferred embodiment, the first two detectors are arranged to be symmetrical with respect to the reference line. Similarly the third and fourth detectors are placed so that they are symmetrical with respect to the reference line for cases in which four detectors are employed.

The active guide includes a rotating member comprised of a plurality of disc-shaped elements arranged for movement about the periphery of a rotating member and engaging the workpiece to impart movement thereto.

The rotatable support rotates about a perpendicular axis, as is described in French Pat. No. 2,457,920 and may alternatively consist of an endless belt whose upper run lies in the plane of the worktable and forms a continuation thereof.

There exist certain situations in which the workpiece recentering means operates in an unsatisfactory manner.

As one example, when the edge of the workpiece lies to close to a portion of the sew line, the recentering means automatically follows the edge of the workpiece without stopping the sewing operation at the spot desired for the end of the sewing operation. As another example, in cases where supple workpieces formed of knitted fabrics undergo considerable rotation, the knitted fabric becomes deformed. These problems are incapable of being overcome by the conventional apparatus described herein.

The present invention overcomes the above-mentioned problems by providing a counting device for counting the stitches along the selvage which may be generated by the reciprocating action of the sewing machine needle arm.

The counting device controls the action of the recentering means by holding the turntable drive means and lifting the active guide when the counting devices reaches the predetermined count which is a function of the length of the sew line.

The digital count may correspond to the number of stitches necessary for providing a seam along a distance slightly less the total length of the edge to be sewn. The detection system may be of the reflector type which is mounted on the active guide in such a way as to be positioned opposite a photoelectric sensor.

When the count reaches a given number, the counting device stops the turntable drive means and lifts the active guide to permit linear stitching.

For safety purposes, a retractable guide stop may be added to the counting device to permit the end of the sewing operation while the edge of the workpiece is guided by the guide surface of the guide stop.

In a second embodiment, the drive device for displacing the workpiece may be comprised of means for varying the advance of the workpiece arranged at a location upstream relative to the point of treatment.

In particular, in the case of a seam, the sewing machine comprises a differential feed dog whose adjustment is controlled during sewing by the counting device. This embodiment is particularly well adapted to control the deformation of a knitted fabric during sewing. For a given type of workpiece, of which the location of the wales of stitches with respect to the edge to be sewn is known, the adjustment of the differential feed dog is predetermined as a function of the expected deformation of the knitted fabric during sewing; and adjustment during sewing is controlled by the counting device as a function of the number of stitches counted from the beginning of sewing.

BRIEF DESCRIPTION OF THE DRAWINGS

The invention will be more readily understood on reading the following description with reference to the accompanying drawings, in which:

FIGS. 3*a* and 3*b* illustrate fabric portions comprising halves of underpants or similar garments.

FIGS. 6 and 7 show a program for control of a recentering means.

DESCRIPTION OF THE PREFERRED EMBODIMENTS

Figure 1:
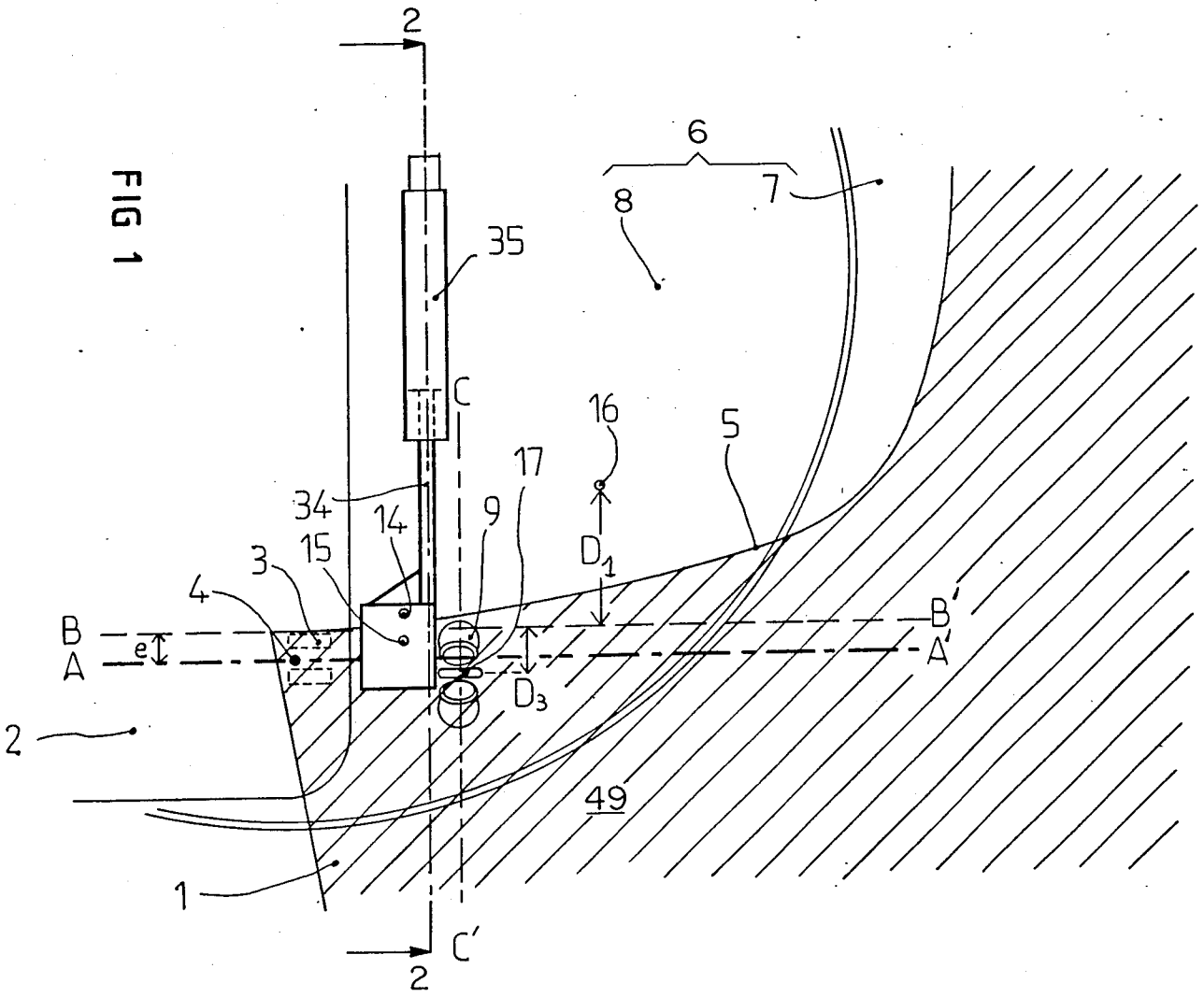
FIG. 1 schematically shows the installation for guiding a textile workpiece in front of a sewing machine, equipped with a guide stop.

Referring now to the drawings, the installation is adapted to edge textile workpieces 1 being made up, for example, to elasticate or similarly treat underpants along a leg opening. This installation comprises a sewing machine 2, especially equipped to effect the edging operation, with its drive device comprising a feed dog 33 and a presser foot 3, and the needle 4 which effects stitching along the stitching line AA' constituting the line of treatment in this embodiment. The stitching must be made at a certain distance e from the edge 5 to be sewn. At the point of stitching, the edge of workpiece 1 is located dotted line BB', parallel to the stitching line AA' and spaced therefrom by the distance e towards the right in the direction of advance of the workpiece 1 in the course of edging.

Around the sewing machine 2, the work table 6 supports the workpiece 1 during and after the edging operation. A part 7 of the table 6 is mobile and is rotatable about axis 6 which is perpendicular thereto: this mobile part, hereinafter referred to as turntable, has an annular form, surrounding the sewing machine 2 and a fixed part 8 of the work table 6. The turntable is driven in one direction or in the other by drive means whose structure is disclosed in U.S. Pat. No. 4,312,281 which discloses bi-directional drive means. Control means for such turntable drive means are also known from U.S. Pat. No. 3,742,878, which patents are incorporated herein by reference thereto.

Figure 5:
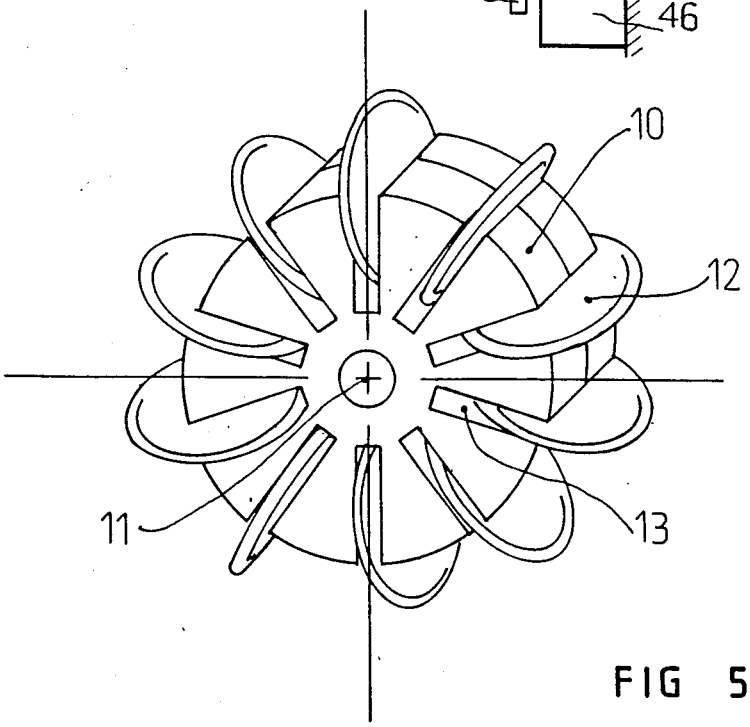
FIG. 5 shows a schematic view in perspective of an active guide.

The active guide 9 is positioned upstream of the presser foot 3, below reference line BB' and level with the fixed part 8 of the work table. This guide 9, as illustrated in FIG. 5, is constituted by a rotatable member 10 rotating about an axis 11 and bearing on its periphery ten discs 12, free to rotate in recesses 13 made radially in the member 10. Guide 9 is placed above the table 6 so that it abuts on the workpiece 1 during edging and so that the plane perpendicular to the table 6 passing through its axis of rotation 11 is parallel to the stitching line AA'. The action of transverse displacement of discs 12 during rotation of the member 10 is effected along line CC' perpendicular to the axis of treatment AA' in a zone 17 located at a distance D3 from the reference line BB'. Distance D3 is a function of the behaviour of the material constituting the workpiece 1 and also of the minimum radius of curvature of the workpiece; in any case, D3 must be sufficient for the active guide 9 always to be in contact with workpiece 1 during the edging operation, as long as said workpiece has not gone beyond line CC'.

Two photoelectric detectors 14 and 15 are placed on either side of the reference line BB' in a plane perpendicular to said line located between the presser foot 3; one, 14, to the right, the other, 15, to the left of line BB', they are placed symmetrically with respect to said line and their spaced apart relationship defines the width of the correct guiding zone and is a function of the distance e admitted for the edging operation. Another photoelectric detector 16 is placed above line BB' and upstream of the active guide 9: it is spaced apart from line BB' by a distance D1 which is much greater than that existing between the detector 14 and the line BB' and which is a function of the minimum radius of curvature of the workpiece 1 to be edged: the greater the curvature of the edge to be treated, the greater the distance D1 will be. Each of the three detectors 14, 15, 16 is designed to emit a signal when the workpiece 1 is present thereabove. The information emitted by the three detectors, concerning presence or absence of the workpiece 1 at each of their positions, makes it possible to know the exact position of the workpiece 1 in front of the sewing head, and to control the turntable 7 and/or the active guide 9 to orient the workpiece 1 during the whole of its edging, in a predetermined program.

Figure 2:
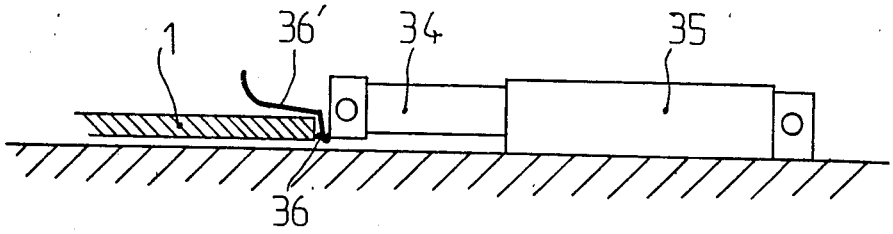
FIG. 2 is a schematic section along the lines 2—2 of FIG. 1.

According to a first embodiment of the counting device, the installation comprises a sensor 30 placed in the upper part of the needle arm or bar 4' and capable of counting the number of "rise" and "fall" movements of said arm 4' during the stitching operation and therefore the number of stitches. Counting devices are generally known from U.S. Pat. No. 4,359,953. A double-acting air cylinder or jack 18, fast with the sewing machine 2, is connected to the support 19 of the active guide 9. Conventional reciprocating jacks are already known and have been utilized in similar environments as described as for example in U.S. Pat. Nos. 3,889,614 and 4,312,281. The latter comprises a horizontal axis of rotation 21 for lifting and lowering part 10 of guide 9 under the action of jack 18. Connection between the rod of jack 18 and support 19 of active guide 9 is ensured by a flexible cable 20; in this way, when discs 12 of guide 9 are applied on workpiece 1, the cable 20 is relaxed and the discs 12 may follow the differences in thickness that the workpiece 1 may present when moving over table 6. Moreover, on table 6 there is positioned a guide stop 34 actuated by a jack 35, fixed on table 6. Guide stop 34 prevents a guide surface 36, against which abuts the edge of the workpiece 1 to be treated, when jack 35 is extended. In that case, guide surface 36 of guide stop 34 is at a distance from the axis of stitching AA' which corresponds substantially to the width e necessary between the axis of stitching AA' and the edge of the workpiece represented by dotted line BB'. Guide surface 36 may, as illustrated in FIG. 2, present a bent form 36' adapted to prevent the edge of the workpiece to be guided from rising and therefore maintaining it against table 6. Jacks 18 and 35 are controlled by the counting device 30.

The installation operates as follows: The workpiece 1 to be edged is placed on the turntable 7, then the corner by which the stitching must begin is introduced beneath the active guide 9 and the pressor foot 3. The sewing machine 2 is switched on and the feed dog 33/presser foot 3 system takes the workpiece 1 along in the direction of stitching line AA'. The preceding three operations, namely placing the workpiece 1 on the turntable 7, introduction beneath the active guide 9 and beneath the presser foot 3, switching on of the sewing machine 2, are carried out either by an operator or automatically. During the edging operation, the recentering means constituted by the active guide 9 and the turntable 7 is selectively operated to guide the workpiece 1 so that the stitching is effected along the edge 5, substantially parallel thereto and at a distance e. It should be understood that guide 9 and turntable 7 may be actuated to move in the same direction (FIG. 6 first example) or in opposite directions (FIG. 6, last example) and in certain instances only one of the guide 9 and turntable 7 will be operated independently of one another (FIG. 6, third example). The action of the recentering means is controlled by the information received from detectors 14, 15, 16 in accordance with a defined program of which an example is given in Table 1 of Enclosure I. The columns headed 14, 15, 16 define the state of each detector depending on whether the workpiece is present (X) above said detector or absent (−). The column headed "active guide" defines either the inaction of the rotatable member 10 (O) or its rotation in the direction driving the workpiece 1 towards the right (D) or its rotation in the direction driving the workpiece 1 towards the left (G). The column headed "turntable" repeats the same parameters as the preceding column for the turntable 7. The right-hand part of the Table illustrates the position of the workpiece with respect to the detectors and the action of the recentering means: arrow f for active guide 9 and arrow F for turntable 7.

Figure 3A:
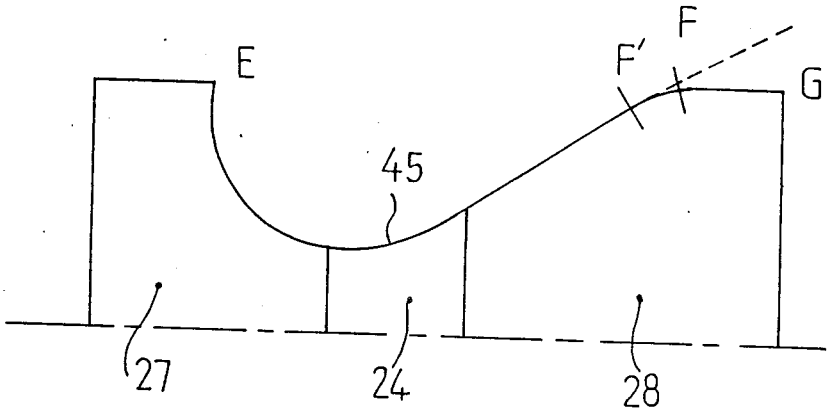
FIGS. 3*a* and 3*b* are different illustrations of textile workpieces of which the edge to be treated does not present a sudden change in direction.

If workpiece 1 presents an edge EF to be treated and if this edge, as illustrated in FIG. 3*a*, has near the point F corresponding to the end of the stitching treatment, an inwardly curved profile, without sudden change in direction, the installation according to the first embodiment of the counting devices operates as follows: The stitch counting device 30 is programmed on the one hand to count the stitches to be counted from the beginning of stitching of each workpiece 1 to be treated, on the other hand for controlling, when the number of stitches counted by the counting device 30 attains a given value which is a function of the size of each workpiece, both the stoppage of the recentering means, namely the stoppage of the drive means of the turntable 7 and the action of jack 18 which raises the active guide 9 and also the action of jack 35 which advances the guide stop 34 in position of operation. By way of example, a pair of underpants, as shown in FIG. 3*a*, has a length EF to be edged equal to 50 cm. It is desired to interrupt the action of the recentering means when the stitching is effected along curve EE′, stitch F′ being distant by 2 cm from stitch F which marks the end of the edge to be treated. The density of stitches obtained by the sewing machine 2 is 5 stitches per centimeter. The given digital value is equal to the number of stitches for covering the distance EF′, viz. 240 stitches. In this way, guiding of workpiece 1 along edge EF′ is obtained thanks to recentering means, turntable 7 and active guide 9, then when the device 30 has counted 240 stitches and therefore stitch F′ is reached, device 30 controls on the one hand the withdrawal of jack 18 which causes the active guide 9 to be lifted and the drive means of the turntable 7 to be stopped and, on the other hand, the extension of jack 35 which presents the surface 36 of the guide stop in guiding position along the edge F′F to be treated. Consequently, the stitching continues along the curve F′F and in continuation thereof (in broken lines in FIG. 3(*a*) and not along edge FG.

Figure 3B:
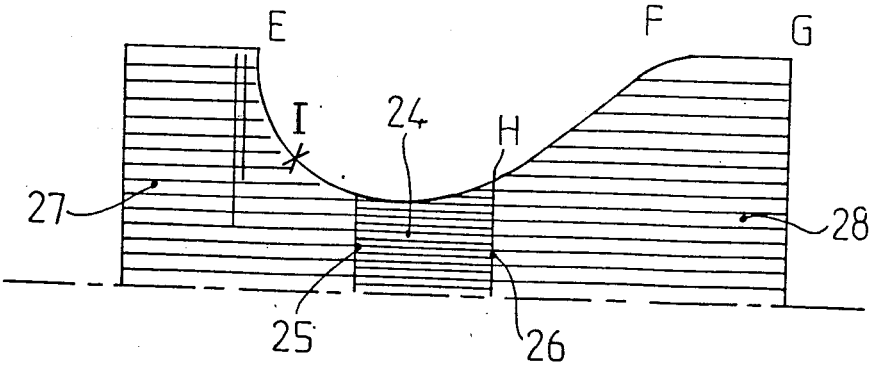

In a variant of this first embodiment of the counting device, the active guide 9 comprises a system for detecting the oscillations to which the discs 12 are subjected when the thickness of the workpiece 1 varies. This system of detection comprises a reflector 31, fast with the support 19 of the active guide 9, and a photoelectric sensor 32. This particular arrangement is especially suitable when the workpiece to be treated is constituted by elements assembled together by stitching and consequently presenting a thickness greater than desired. FIG. 3*b* shows a pair of underpants, to be edged along EF, which is constituted by three pieces 24, 27 and 28 assembled together by sewing. Due to the imprecision of the cut for each of the pieces to be assembled and also by reason of the assembly zones 25 and 26, there are considerable differences in length from one workpiece to the other for the same edge EF to be treated; such differences are detrimental to the precision in following the profile F′F, the recentering means being stopped either too early, or too late. In order to reduce this discrepancy, the counting device 30 is programmed to count the number of stitches, no longer from the beginning E of stitching, but from stitch H. The imprecision is therefore limited to the difference over length HF alone (and no longer EF). Beginning-of-count stitch H is located thanks to a system detecting the vertical movements of the active guide 9. The crotch 24 of the underpants is constituted by two pieces of knitted fabric and therefore has a thickness double that of the back 28; the passage of the discs 12 of the active guide from the crotch 24 to the back 28 thus creates a descending movement of the active guide 9, which movement is detected by the displacement of the reflector 31 in front of the photoelectric sensor 32: the signal obtained allows the beginning of the counting of stitches by device 30.

According to a second embodiment of the counting device, the installation comprises, in addition to the counter 30 placed in the upper part of the needle arm 4′, a differential feed dog 48. As is known, this feed dog is placed upstream of the needle 4 and is animated by a movement allowing the workpiece 1 to advance at a speed greater, equal or less than that of feed dog 33. Such differential feed dogs are known from U.S. Pat. No. 4,067,274. Automatic feed control means are known from U.S. Pat. Nos. 3,980,032; 3,808,995 and 4,412,498. The differential feed dog 48 is controlled by counting device 30. This particular arrangement is especially useful when the workpiece 1 to be treated is a knitted fabric which will tend to be deformed during treament. Such deformation is compensated by the operator when the stitching is done manually; in automatic mode, it will be compensated thanks to the variations of adjustment of the differential feed dog preprogrammed as a function of the number of stitches counted by counter 30. If the underpants shown in FIG. 3*b* are considered, the selvage EF to be edged may be divided approximately into three parts as a function of the direction of the rows and wales of stitches: part EI of which the direction is substantially parallel to the rows of stitches; part IH whose direction is substantially perpendicular to the rows of stitches (and therefore parallel to the wales of stitches); and part HF whose direction is oblique with respect to the wales of stitches. During stitching along edge EF, the passage of the knit (herein the term "knit" is used as an abbreviation for a knitted workpiece) in the drive members (feed dogs 33,48) of the sewing machine provokes extensions which vary depending on whether the line of stitching AA′ is parallel, perpendicular or oblique with respect to the wales of stitches: for example, along part EI, the knit will tend to undergo a considerable extension during its passage beneath the drive members of the sewing machine; along part IH, no extension, and along part HF a weaker extension. If distance EF is 60 cm in all, with EI equal to 10 cm, IH to 27 cm and HF to 23 cm, and if the stitch density is 5 stitches per centimeter, the counter 30 is preprogrammed to begin to count the number of stitches from point E, beginning of stitching of each workpiece 1, and to successively control a linear speed of the differential feed dog 48 clearly greater than that of feed dog 33 from 0 to 50 stitches; equal to that of feed dog 33 from 51 to 185 stitches, and slightly greater than that of feed dog 33 from 186 to 300 stitches. The variation of the linear speed of the differential feed dog 48 is obtained by changing the amplitude of the horizontal movement of said feed dog.

In certain cases, difficulties in guiding may arise with underpants made of slippery knits such as, for example, fine lace or non-run fabrics for ladies' briefs.

Crotch 24 of the underpants (FIG. 3*a*) is constituted by two layers of knit of which the edges 45 to be stitched are matched when this crotch 24 is assembled with the front 27 and the back 28 of the garment. When this part 24 is subjected to the action of the active guide 9, the latter comes into contact with the upper layer and drives it transversely to the direction of stitching in accordance with the process described hereinabove. However, as the upper layer slides more easily on the lower layer than the lower layer slides on the fixed part 8 of the work table, this lower layer does not follow the movement imposed by the active guide 9. This results in a shifting of the two edges to be stitched, which is inadmissible.

Figure 4:
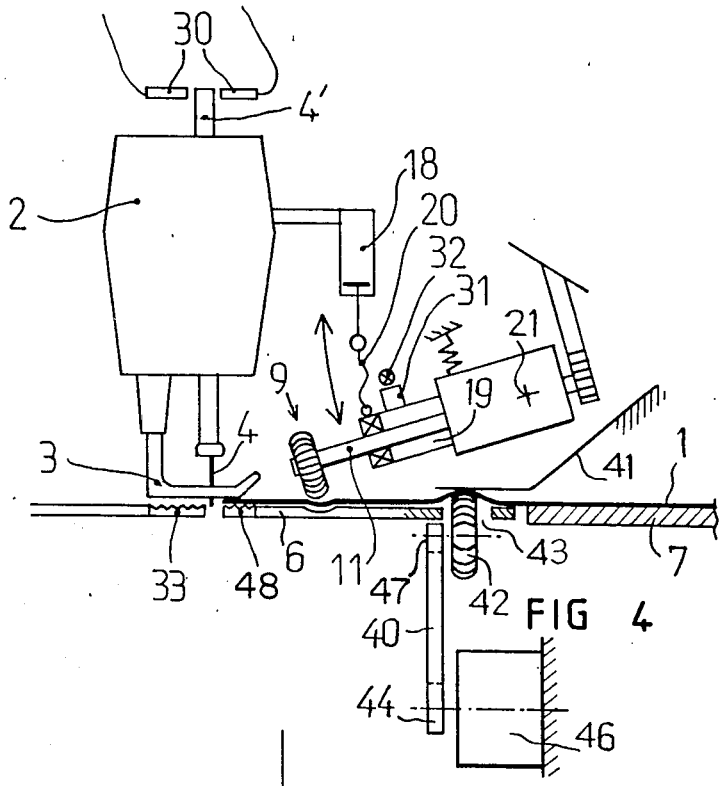
FIG. 4 is a schematic view of the installation in section.

In order to overcome this drawback, a second, lower, active guide 42 may complete the action of the upper guide 9 (FIG. 4). This second guide 42 is identical to guide 9. It is placed beneath the fixed part 8 of the work table and emerges by some millimeters through the recess 43. Rotation thereof is obtained by drive means 46 similar to those of guide 9 and by a pulley/belt/pulley assembly 44/40/47. A flexible blade 41 fast with the frame exerts above the knit a pressure in the direction of table 6 in order to urge the lower layer of knit against the active guide 42.

Rotation of active guides 9 and 42 is controlled by the same information received from detectors 15 and 16. The two guides therefore act simultaneously, upper guide 9 rotating anti-clockwise and lower guide 42 in the opposite direction, or vice versa. Each guide acts on a thickness of knit and moves it by the same amount. Consequently, edge-to-edge matching is maintained.

According to a particular embodiment of the invention, the drive means of the turntable 7 allow said turntable to be driven at two different speeds, this making it possible to accelerate in certain cases the modifications of orientation of workpiece 1 with respect to the line of stitching. Multispeed drive means for turntables are already known from U.S. Pat. No. 4,312,281. Moreover, the sewing machine 2 also has a normal speed and a slow speed, the latter being advantageously used in the event of a curvature to be corrected which is particularly marked i.e., extreme. Multispeed drive and control means for sewing machines are already known from U.S. Pat. No. 4,359,953. FIGS. 6 and 7 give an example of program for control of the two recentering means and of the sewing machine 2 as a function of the information emitted by the three detectors 14, 15, 16. In the column headed "turntable", the speed of the drive means has been differentiated by using a capital letter for high speed and a small letter for the low speed.

In a specific embodiment, the arrangement of the different means with respect to one another is as follows: Taking as origin the stitch 4 and as reference axis the line of stitching AA', the three detectors 14, 15 and 16 are located respectively at 40, 32 and 70 mm from the needle and 5, 2 and 30 mm from the line of stitching AA'. The active guide 9 has an outer diameter of 24 mm, each of the ten discs has a diameter of 8 mm. The axis of rotation 11 of the active guide 9 makes an angle of a 35° with the work table 6. The point of contact of the active guide 9 with the work table 6 is on the line of stitching AA', at 45 mm from the needle 4. The fixed part 8, inside the turntable 7, has a diameter of 480 mm, its center being located on the perpendicular to the axis of stitching AA' passing through the needle 4 at a distance of 200 mm therefrom. The speed of the sewing machine 2 in normal operation is 4170 r.p.m., in slow operation, 2000 r.p.m.

The above example has been given by way of illustration and does not limit the invention. Other types of active guide may for example be used, such as the one described in French Pat. No. 2 518 134, i.e. a guide wheel whose axis of rotation is parallel to the line of stitching AA' and applied on the workpiece with a modulatable pressure. Other types of mobile support may be used, such as an endless belt of which the surface of the upper edge, on which is placed the workpiece 1, is in the plane of the work table and in continuation thereof. The belt is associated with drive means allowing it to be displaced in both directions; it is directed either transversely with respect to the line of stitching AA', or obliquely with respect to said line, in which case it ensures recentering of the workpiece and it also facilitates the advance of the workpiece 1 towards the stitching head 4. This latter arrangement is particularly advantageous in the case of a heavier workpiece.

More than three detectors may also be employed, for example, by adding a fourth detector 49 symmetrically to the third detector 16 with respect to the reference line BB'. This complementary arrangement makes it possible to recenter very precisely the edges presenting convex curvatures, such as the one illustrated in FIG. 3*b*. In that case, the turntable 7 will advantageously be animated by two speeds towards the right.

What is claimed is:

1. In an installation for linear treatment of a workpiece, such as stitching, along a line of which the direction remains substantially parallel to an edge of a supple workpiece such as a textile piece, of the type comprising:

a fixed linear treatment machine having a fixed point of treatment, such as a sewing machine said machine including a feed dog and a presser foot;

a drive device for drawing said feed dog and presser foot for displacing, with respect to the treatment machine, the zone of the workpiece being treated, along a predetermined line axis of treatment;

a worktable extending around said drive device, said table being located substantially at the level of said point of treatment, and being adapted to support the workpiece during treatment thereof;

a correction device comprising a detecting device for detecting the presence of the workpiece and recentering means controlled by said detection device for displacing the workpiece substantially transversely with respect to the line of treatment and in an appropriate direction, as a function of the position of the workpiece, so that said workpiece is treated by the treatment machine along a line extending substantially parallel to the edge of the workpiece, said recentering means comprising two distinct means including:

at least one active guide, placed in the vicinity of the drive device of the treatment machine, upstream thereof in the direction of displacement of the workpiece during treatment, said active guide being rotated to move the workpiece thereby ensuring the displacement of that part of the workpiece located near the point of treatment, substantially transversely with respect to the line of treatment;

and a movable support, displaced from the active guide, presenting a movable flat surface lying in the same plane as the worktable, controlled by drive means for displacing said movable flat surface, said movable support being moved for ensuring the displacement of the upstream part of the workpiece, and the active guide and the drive means of the movable support being selectively controlled, together or independently of each other, by the instructions given by the detection device.

2. The installation of claim 1, wherein the active guide consists of a member applied on the workpiece and moving the workpiece by sliding it over the work table.

3. The installation of claim 2, wherein the active guide comprises a rotary member with means which come into contact with the workpiece and rotates about an axis lying in a vertical plane substantially parallel to the axis of treatment, said rotating member comprising on its periphery a plurality of identical elements, adapted to successively come into contact with the workpiece, each of said elements having the form of a disc, being free to rotate and being placed in a radial plane with respect to the axis of rotation of the rotating member.

4. The installation of claim 1, wherein the movable support consists of a rotatable surface which forms a revolving part of the worktable and surrounds a stationary part of the worktable.

5. The installation of one claim 1, wherein the drive means of the movable support comprise means for driving the movable support at at least two different drive speeds, and in two opposite directions.

6. The installation of one of claim 1 wherein the detection device also includes means which controls the speed of the linear treatment machine.

7. The installation of claim 6, wherein the linear treatment machine includes means for operating said machine at at least two operating speeds.

8. The installation of claim 1, wherein the detection device comprises three detectors:

first and second detectors being situated on either side of and spaced apart from a reference line, parallel to the line of treatment and tangential to the edge of the workpiece at the point of treatment, and a third detector being located upstream of the active guide, to the right of and substantially remote from said reference line.

9. The installation of claim 8, wherein the detection device comprises a fourth detector, located upstream of the active guide, to the left of and substantially remote from the reference line.

10. The installation of claim 1, further comprising a second active guide which is located beneath the worktable for moving the workpiece from the underside thereof.

11. The installation of claim 1, further comprising a counting device capable of generating a digital value representing the treatment along a line parallel to the edge of the workpiece and controlling the drive means as a function of the digital value obtained.

12. The installation of claim 11, wherein said counting device is adapted to stop the drive means of the turntable and to lift the active guide as soon as the digital value counted by the counting device has attained a given value, which is a function of the length of the edge to be treated.

13. The installation of claim 12, wherein the given value corresponds to the value obtained for a treatment over a distance equal to the total length or a distance slightly less than the total length of the edge to be treated.

14. The installation of claim 12, wherein the given value corresponds to the value obtained for a portion included between a locatable point and the end of the edge to be treated, and the counting device begins to count only from said locatable point.

15. The installation of claim 14, further comprising a system for detecting overthickness, consisting of a reflector element and a photoelectric sensor element, one of said elements being mounted on the support of the active guide and the other of said elements placed opposite said first-mentioned element and being capable of locating a point of assembly along the edge of a workpiece to be treated constituted by at least two pieces.

16. The installation of claim 12, further comprising a retractable guide stop controlled by the counting device so that the guide surface of the guide stop is positioned, as soon as the digital value attains the given value, at a distance from the line of treatment which corresponds substantially to the necessary width of the workpiece, whereby, after the drive means of the turntable have been stopped and the active guide has been lifted, the edge to be treated is guided by the guide surface of the guide stop.

17. The installation of claim 11, wherein the counting device controls means engaging the workpiece for varying the advance of the workpiece in front of the point of treatment along the edge to be treated.

18. The installation of claim 17, wherein the means for varying the advance of the work piece consist of a differential feed dog placed upstream of the device for driving the workpiece to be treated.

19. The installation of claim 18, wherein the counting device is programmed in order to control the means for variation along certain portions of the edge to be treated in order to compensate the deformation of the workpiece to be expected in the course of treatment of said portions.

20. The installation of claim 17, wherein the counting device is programmed in order to control the means for varying the advance of the workpiece along certain portions of the edge to be treated in order to compensate for the deformation of the workpiece to be expected in the course of treatment of said portions.

21. The sewing installation of claim 11, wherein the counting device comprises a detector placed at the level of the needle arm of the sewing machine and which counts movement of the needle arm for counting the number of stitches.

* * * * *

UNITED STATES PATENT AND TRADEMARK OFFICE

CERTIFICATE OF CORRECTION

PATENT NO. : 4,682,553

DATED : July 28, 1987

INVENTOR(S) : Jean-Marie Bachmann; Jacques Pion; Jean-Pierre Raisin

It is certified that error appears in the above-identified patent and that said Letters Patent is hereby corrected as shown below:

IN THE SPECIFICATION

Column 3, delete lines 3 and 4.
line 19, before "dotted" insert --along--.
line 26, delete "6", and insert "an" before "axis".

Column 4, line 50, change "pressor" to --presser--.
line 64, change "FIG. 6" to --Table 1--.
line 65, change "FIG. 6" to --Table 1--.
line 67, change "FIG. 6" to --Table 1--.

Column 5, line 21, change "direction, the" to --direction. The--.
line 37, change "EE'" to --EF'--.

Column 7, line 54, change "FIGS. 6 and 7 give" to --Table 2 in Enclosure II gives--.

Column 8, line 2, delete "a".
Column 8, line 38, before the Claims, insert the attached tables.

Signed and Sealed this

Twelfth Day of January, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,682,553

DATED : July 28, 1987

INVENTOR(S) : Jean-Marie Bachmann; Jacques Pion; Jean-Pierre Raisin

It is certified that error appears in the above-identified patent and that said Letters Patent is hereby corrected as shown below:

Enclosure I

TABLE I

| 14 | 15 | 16 | active guide | turn-table | |
|---|---|---|---|---|---|
| X | X | X | G | G | 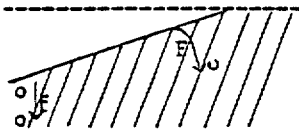 |
| - | X | - | O | O | 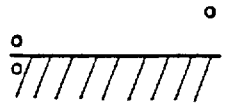 |
| - | X | X | O | G | 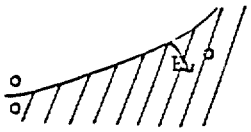 |
| - | - | - | D | D or O | 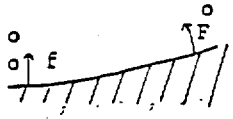 |
| - | - | X | D | G | 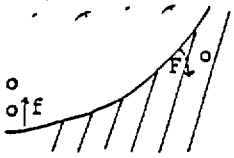 |

UNITED STATES PATENT AND TRADEMARK OFFICE

CERTIFICATE OF CORRECTION

PATENT NO. : 4,682,553

DATED : July 28, 1987

INVENTOR(S) : Jean-Marie Bachmann; Jacques Pion; Jean-Pierre Raisin

It is certified that error appears in the above-identified patent and that said Letters Patent is hereby corrected as shown below:

Enclosure II

TABLE 2

| 14 | 15 | 16 | active guide | turn-table | sewing machine | |
|---|---|---|---|---|---|---|
| X | X | X | G | G | slow | 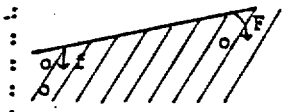 |
| X | X | - | G | g | normal | 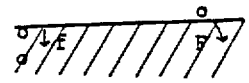 |
| - | X | - | O | O | normal | 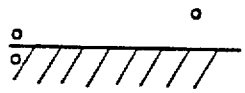 |
| - | X | X | O | G | slow | 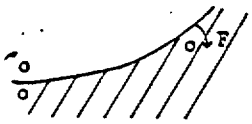 |
| - | - | - | D | d or O | normal | 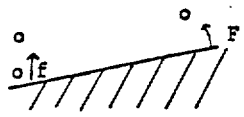 |
| - | - | X | D | G | slow | 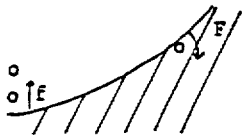 |